US006890047B2

(12) United States Patent
Fujibayashi et al.

(10) Patent No.: US 6,890,047 B2
(45) Date of Patent: May 10, 2005

(54) PRINTING APPARATUS AND PRINTING METHOD

(75) Inventors: Mitsuyuki Fujibayashi, Tokyo (JP); Hideo Fukazawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/803,105

(22) Filed: Mar. 12, 2001

(65) Prior Publication Data

US 2001/0026297 A1 Oct. 4, 2001

(30) Foreign Application Priority Data

Mar. 13, 2000 (JP) ..... 2000-069319

(51) Int. Cl.[7] ..... B41J 29/38
(52) U.S. Cl. ..... 347/12; 347/19
(58) Field of Search ..... 347/14, 19, 37, 347/39, 12

(56) References Cited

U.S. PATENT DOCUMENTS 4,328,504 A * 5/1982 Weber et al. ..... 347/19
5,168,291 A 12/1992 Hiramatsu et al. ..... 347/19
5,397,192 A * 3/1995 Khormaee ..... 400/708
5,448,269 A * 9/1995 Beauchamp et al. ..... 347/19
5,534,895 A * 7/1996 Lindenfelser et al. ..... 347/19
5,627,570 A 5/1997 Hiramatsu et al. ..... 347/19
5,883,646 A * 3/1999 Beauchamp ..... 347/19
5,923,344 A * 7/1999 Norum et al. ..... 347/9
5,956,055 A * 9/1999 Gibson et al. ..... 347/40
6,084,607 A * 7/2000 Matsuda ..... 347/19
6,227,644 B1 * 5/2001 Perner ..... 347/19
6,350,004 B1 * 2/2002 Askren ..... 347/14
6,367,903 B1 * 4/2002 Gast et al. ..... 347/9

* cited by examiner

*Primary Examiner*—Lamson Nguyen
*Assistant Examiner*—Blaise Mouttet
(74) *Attorney, Agent, or Firm*—Fitzpatrick, Cella, Harper & Scinto

(57) ABSTRACT

The present invention is to provide a printing apparatus and printing method capable of stably printing an image with high accuracy by avoiding effects of a dimensional error and printing characteristics specific to a printing head and a mounting error of the printing head. For this purpose, a printing condition detector is mounted on a carriage moving in a primary scanning direction, and a printing head is mounted replaceably on the carriage. An image printed on a printing medium by the printing head is detected by the printing condition detector, and the printing head is controlled according to the detection result.

10 Claims, 3 Drawing Sheets

PRINTING APPARATUS AND PRINTING METHOD

This application is based on Patent Application No. 2000-69319 filed Mar. 13, 2000 in Japan, the content of which is incorporated hereinto by reference.

BACKGROUND OF THE INVENTION

1. Field of the Invention

The present invention relates to a printing apparatus and printing method for printing an image on a printing medium while relatively moving a printing head provided with a plurality of printing elements and the printing medium.

2. Description of the Prior Art

In a prior art printing apparatus such as of an ink-jet type, a dimensional error specific to the printing head, a mounting error associated with attachment and detachment of the printing head, and printing characteristics specific to the printing head have been greatly affecting the printing condition of the image.

However, if the printing condition of the image is varied due to such dimensional error, printing characteristics and mounting error of the printing head specific to the printing head, it was difficult to sufficiently meet the requirements for improved performance of the printing apparatus.

SUMMARY OF THE INVENTION

It is therefore an object of the present invention to provide a printing apparatus and printing method capable of printing an image stably and with high accuracy while avoiding effects of a dimensional error and printing characteristics specific to the printing head and a mounting error of the printing head.

In a first aspect of the present invention, there is provided a printing apparatus for printing an image on a printing medium while relatively moving a printing head provided with a plurality of printing elements and the printing medium characterized by comprising:

detection means capable of moving along with the printing head relative to the printing medium for detecting image printed on the printing medium; and control means for controlling the printing head according to a detection result of the detection means.

In a second aspect of the present invention, there is provided a printing method for printing an image on a printing medium while relatively moving a printing head provided with a plurality of printing elements and the printing medium characterized in that:

an image printed on the printing medium is detected by detection means moving along with the printing head relative to the printing medium; and the printing head is controlled according to a detection result of the detection means.

In the present invention, detection means is used. The detection means is capable of detecting the image printed on the printing medium by moving along with the printing head relative to the printing medium. The printing head is controlled according to the detection result of the detection means. To be more concrete, the driving of the plurality of printing elements in the printing head is controlled. Actual printing result information by the plurality of printing elements in the printing head is fed back, thereby these printing elements are controlled according to the actual situation. As a result, the image can be printed stably and with high accuracy by avoiding effects of a dimensional error printing characteristics specific to the printing head and a mounting error of the printing head.

Further, by providing the detection means and replaceably mounting the printing head to the carriage of a serial-type printing apparatus, control contents for the printing head can be corrected. Thereby, particularly, the effects of the printing characteristics of each of the replaceable printing heads and mounting error due to attachment and detachment of the printing head are avoided. As a result, stable printing can be achieved without variation of printing characteristics specific to the printing head.

In this case, the plurality of printing elements in the printing head mounted on the carriage can be arranged in a direction crossing with the primary scanning direction of the carriage. And, the plurality of detection elements in the detection means can be disposed at predetermined positions of the carriage so that the detection elements are along a specified direction crossing with the primary scanning direction of the carriage. Using the plurality of detection elements, the printing image can be surely detected. Further, the plurality of detection elements may be those which detect printing images or printing pixels printed by at least two printing elements. Still further, the control means can control drive timings of the plurality of printing elements in the printing head according to a difference in detection time of the printing image or printing pixel by the plurality of detection elements. Thereby, deviations of printing positions can be corrected.

Further, by the detection means provided commonly for the plurality of printing heads, an image printed by each of the plurality of printing heads can be detected. Thereby, the actual situations of the plurality of printing heads are efficiently detected, and the detection results can be utilized in controlling these printing heads.

Yet further, as the detection means, a light source for emitting light and a photoelectric conversion element for receiving reflected light from the printing medium can be used. Yet further, as the printing head, it is possible to use an ink-jet printing head provided with a plurality of ink ejectable printing elements.

The above and other objects, features and advantages of the present invention will become more apparent from the following description of embodiments thereof taken in conjunction with the accompanying drawings.

DETAILED DESCRIPTION OF THE PREFERRED EMBODIMENTS

In the following, embodiments of the present invention will be described with reference to the drawings. The present embodiment is an application example of an ink-jet printing apparatus and ink-jet printing method for forming an image on a printing medium.

Figure 1:
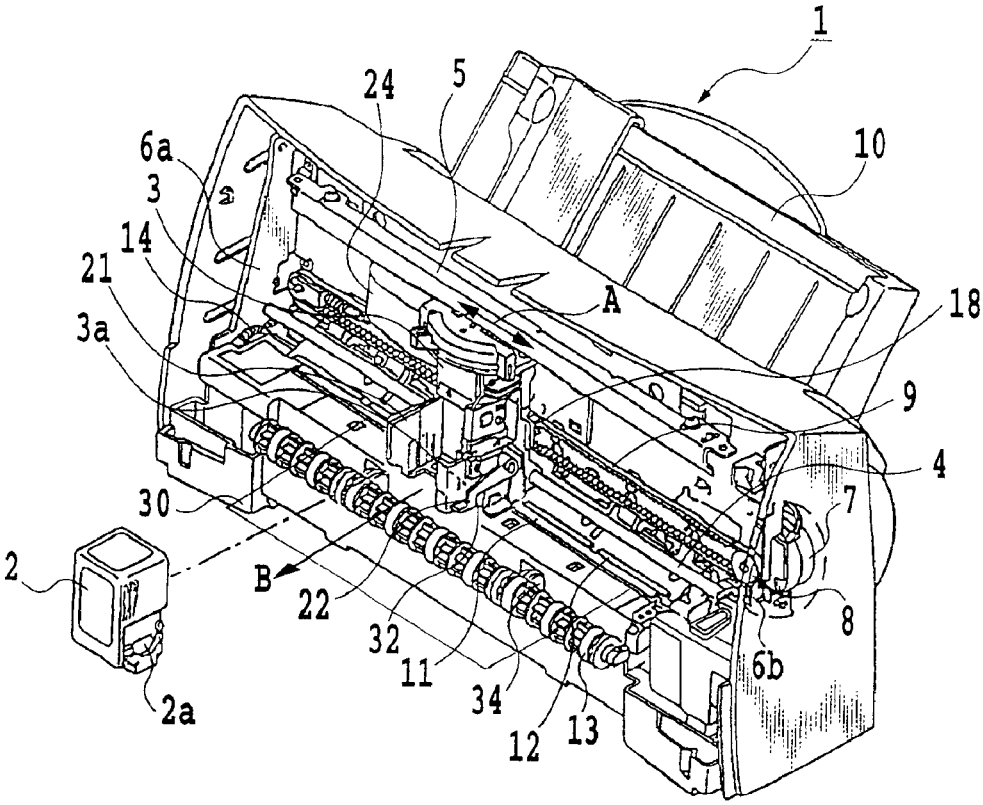
FIG. 1 is a perspective diagram showing part of the printing apparatus in an embodiment according to the present invention.

FIG. 1 is a perspective diagram of an ink-jet printing apparatus 1, which represents features of the present invention. In FIG. 1, numeral 2 denotes an ink-jet printing head provided with a plurality of nozzles constituting a plurality of printing elements. The respective nozzles are provided so as to eject an ink in the downward direction in the figure. As the ink ejection method, any of a method using a piezoelectric element and a bubble-jet method for ejecting ink by a bubble in the ink generated by thermal energy and the like may be employed. In the case of the bubble-jet method, by an electrothermal converter provided in the nozzle communicating with the ink ejection opening, thermal energy utilized as ink ejection energy is generated. That is, in association with bubble generation of ink by the thermal energy, an ink droplet can be ejected from the ink ejection opening. Numeral 3 is a carriage for mounting the printing head 2 and which carriage is connected to a timing belt 9. The timing belt 9 is mounted between a drive pulley 8 and a guide pulley (not shown). By rotating the drive pulley 8 by a carriage motor 7, the carriage 3 is reciprocally moved in the primary scanning direction of arrow A through the timing belt 9. The carriage 3, by being slidingly moved on a slide shaft 4 and a slide plate 5 fixed between chassis 6*a* and 6*b*, with a regulated posture, is reciprocally moved to a position opposite to a paper 30 as a printing medium. The paper 30 is stacked in a paper feed unit 10, and, as necessary, is fed onto a platen by a paper feed roller (not shown), and a portion thereof on the platen is formed with an image by the printing head 2. That is, by repeating a printing operation and a feeding operation, images are successively printed on the paper 30. In the printing operation, the printing head 2 ejects an ink droplet while moving in the primary scanning direction. In the feeding operation, the paper 30 is fed a predetermined amount in a secondary scanning direction by arrow B by a transportation roller 11 and a paper discharge roller 13.

To the transportation roller 11, rotation of the transportation motor (not shown) appropriately reduced by a gear train 14 is transmitted. Numeral 12 is a pinch roller which is disposed at a position pressing against the transportation roller 11. The paper 30 is pressed between the transportation roller 11 and the pinch roller 12, so that the transportation force is surely transmitted. A transmission roller 34 rotates the paper discharge roller 13 slightly faster than the transportation roller 11. An area between the transportation roller 11 and the paper discharge roller 13 is a printing area, which is set as a larger area than a maximum printing width by all nozzles of the printing head 2, thereby in the printing area, flatness of the paper 30 is secured. The right side position in FIG. 1 is a stand-by position of the printing head 2, at which a recovery operation for recovering the ink ejection condition of the nozzle is performed. Numeral 32 is a printing condition detector as detection means mounted on the carriage 3, which, as will be described later, is provided with a plurality of detection elements.

Figure 2:
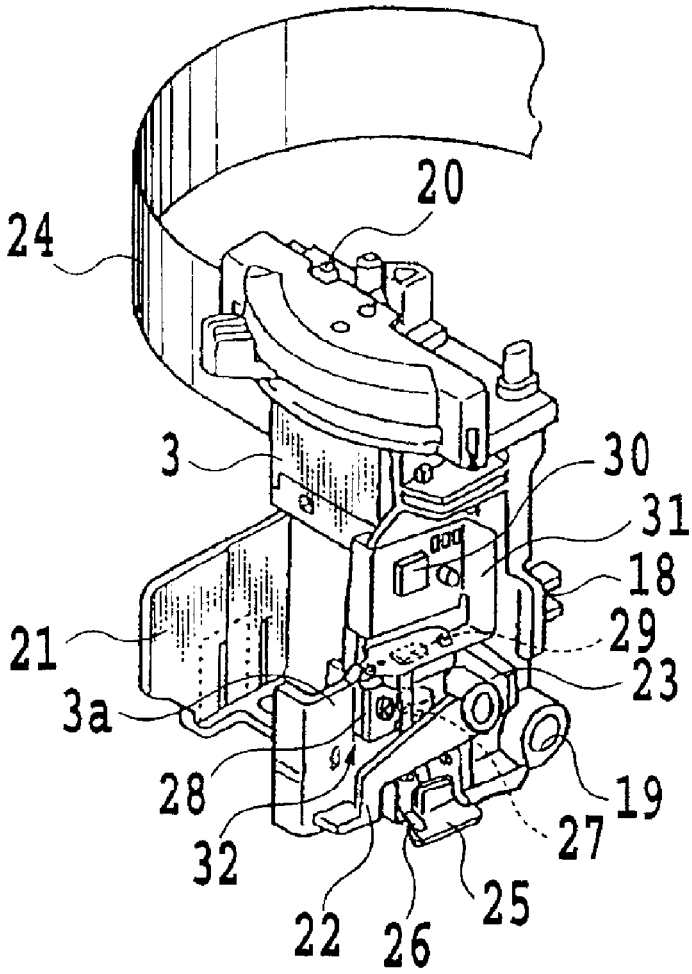
FIG. 2 is a perspective diagram showing peripheral part of a printing condition detector in FIG. 1.

FIG. 2 is an enlarged perspective diagram showing a portion for explaining the construction of the printing condition detector 32.

In FIG. 2, numeral 26 is a light source unit for irradiating light to an image printing part on the paper 30. Reflected light from the image printing part on the paper 30 is focused by a focusing lens 27 disposed vertically above the paper 30, on a detection element (not shown) of a reading sensor 29. The reading sensor 29 and the focusing lens 27 are integrated by a lens holder 28, which is incorporated with the carriage 3 after position adjusting. The reading sensor 29 is mounted to the lens holder 28 through a flexible cable 31, and transmits a read signal of reflected light from the image printing part on the paper 30 to an image processing circuit 30 on the flexible cable 31. The image processing circuit 30 transmits a processing result of the read signal through a flexible cable 24 to a processing circuit of a printing apparatus main body. Numeral 19 is a bearing in sliding contact with the slide shaft 4, and 26 is a pressing member for pressing the light source unit 25 to a predetermined position. Further, numerals 20 and 23 are slide members slidably guided by the apparatus main body side guide member including the slide plate 5. Still further, numeral 18 is a sensor for detecting a moving position of the carriage 3.

The printing head 2 can be mounted between a contact portion 3*a* and a head holder 21 of the carriage 3. By rotation of a lever 22, a contact portion 2*a* (see FIG. 1) of the printing head 2 is pressed against the contact portion 3*a* of the carriage 3 so that these components electrically contact each other. The printing signal is inputted from the flexible cable 24 to the printing head 2 through the contact portion 3*a* and the contact portion 2*a*, and the printing head 2 ejects ink droplets according to the printing signal.

Figure 3C:
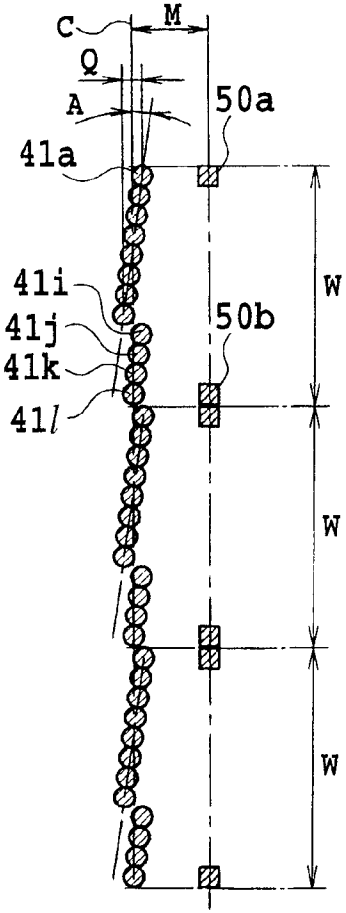
FIG. 3C is a diagram for explaining the positional relation between a printing dot and a detection element after ink ejection timing adjustment of the printing head of FIG. 1.
Figure 3B:
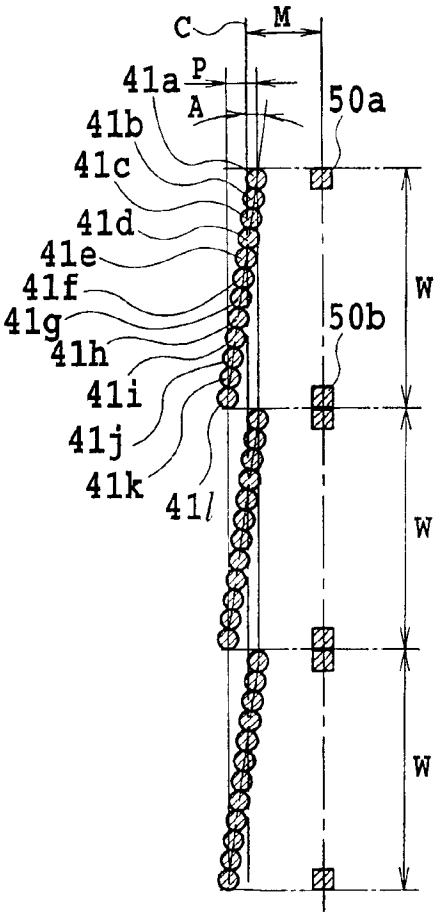
FIG. 3B is a diagram for explaining the positional relation between a printing dot and a detection element before ink ejection timing adjustment of the printing head of FIG. 1.
Figure 3A:
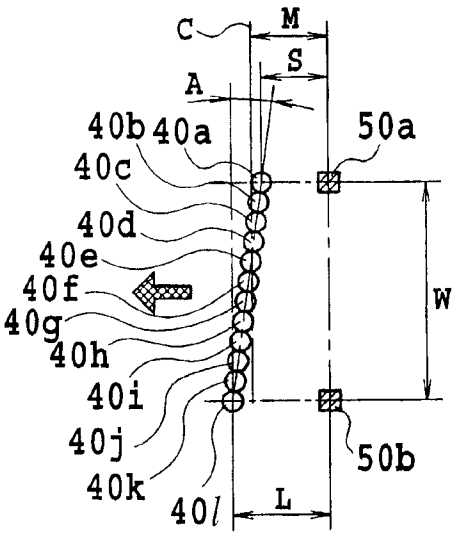
FIG. 3A is a diagram for explaining the positional relation between a detection element and an ink ejection opening of the printing head of FIG. 1.

FIG. 3A is a diagram for explaining the relationship among detection devices 50*a* and 50*b* of the printing condition detector 32 fixed in a predetermined position on the carriage 3 and ink ejection openings 40*a* to 40*l* of the printing head 2 replaceably mounted on the carriage 3. FIG. 3A is a diagram of the detection devices 50*a* and 50*b* and the ink ejection openings 40*a* to 40*l* when viewed from vertically above the surface of the paper 30. In the case of the present embodiment, when the carriage 3 scans in the direction of the arrow in the figure, the printing head 2 performs the printing operation. The array of the ink ejection openings 40*a* to 40*l* should essentially be along a design center C perpendicularly crossing with the primary scanning direction of the arrow in the figure. However, because of dimensional error of the printing head 2 and a mounting error of the printing head 2 to the carriage 3, the array of the ink ejection openings 40*a* to 40*l* (nozzle array) inclines by an angle A relative to the design center C. Further, the printing condition detector 32 of the present embodiment has two detection elements 50*a* and 50*b*, which are mounted on predetermined positions of the carriage 3 after position adjusting so that they are arranged in a direction perpendicular to the primary scanning direction of the arrow in the figure, that is, positioned in the vertical direction in FIG. 3A. The array of the detection elements 50*a* and 50*b* in the vertical direction in FIG. 3A is set to be parallel to the design center C and to be in a position away from the center C by a predetermined distance M in the primary scanning direction. Further, the detection elements 50*a* and 50*b* are positioned away from each other by the same width as a maximum printing width W per scan of the printing head 2.

When the array of the ink ejection openings 40*a* to 40*l* of the printing head 2 is inclined as shown in FIG. 3A, a distance S between the ink ejection opening 40*a* and the detection element 50*a* is smaller than the distance M, and a distance L between the ink ejection opening 40*l* and the detection element 50*b* is greater than the distance M.

FIG. 3B is a diagram for explaining printing dots (printing pixels) 41*a* to 41*l* formed by the printing head 2 mounted in the condition that the array of the ink ejection openings 40*a* to 40*l* is inclined relative to the direction perpendicularly crossing with the scanning direction of the printing head 2 as shown in FIG. 3A. In FIG. 3B, one ink droplet was ejected per scan from each of the ink ejection openings 40*a* to 40*l*. Printing dots 41*a* to 41*l* are printing dots formed by ink droplets ejected from the respective ink ejection openings 40*a* to 40*l*. Inclination of the array of the printing dots 41*a* to 41*l* corresponds to inclination of the ink ejection openings 40*a* to 40*l*. Symbol P in FIG. 3B represents a deviation amount between printing dots 41*a* and 41*l* in the primary scanning direction, that is, a deviation amount between the ink ejection openings 40*a* and 40*l*, which corresponds to a distance (L-S). During scanning of the carriage 3, the detection elements 50*a* and 50*b* immediately detect optically the printing dots 41*a* and 41*l* printed by the printing head 2. When a difference in detection time of these printing dots 41*a* and 41*l* is greater than a printing time for 1 dot as a minimum printing resolution, print timing of the image is adjusted. That is, as shown in FIG. 3B, a difference in detection time of the printing dots 41*a* and 41*l* is greater than 1 dot printing time as the minimum printing resolution, and it is judged that adjustment of ink droplet ejection timing is necessary.

In the present embodiment, among ink ejection openings at one end side and the other end side of the ink ejection opening array (nozzle array), one of a greater deviation amount from the center C (in the present embodiment, the ink ejection opening 40*l* side) is determined as an adjustment subject side. Ink droplet ejection timing of the ink ejection openings (in the present embodiment, ink ejection openings 40*i*, 40*j*, 40*k*, and 40*l*) out of the tolerable deviation range of 1 dot as the minimum printing resolution is shifted by 1 dot printing time. The ink ejection openings out of the tolerable deviation range of 1 dot can be selected from the relation of the distance P determined from the detection time difference of the detection elements 50*a* and 50*b*, the printing width W, and the arrangement position of the ink ejection openings.

As a result of this ejection timing adjustment, printing dots are formed as shown in FIG. 3C, in which a deviation amount Q of printing dots 41*a* to 41*l* is smaller than 1 dot as the minimum printing resolution. As shown, the image can be printed with high accuracy by correcting the deviation in formation position of printing dots to a small value.

Further, a control system of the printing apparatus according to the present invention can be a system configuration including a CPU, ROM and RAM. In this case, the CPU executes a processing for the above-described ejection timing adjustment according to a program stored in the ROM. For example, the CPU first determines whether or not a difference in detection time of printing dots 41*a* and 41*l* by the detection elements 50*a* and 50*b* is greater than the time for 1 dot as the minimum printing resolution. When the detection time is greater than 1 dot printing time, it is determined that print timing adjustment is necessary, and an ink ejection opening to be subjected to ejection timing adjustment is selected as described above. In the selection, a data table can be used. Then, a control signal is sent to a control circuit of the printing head 2 so that ejection timing of an ink droplet from the selected ink ejection opening is shifted. The RAM can be used as a work area for the processing of the CPU. Further, under the control of the CPU, through a driver, the printing head 2, the carriage motor 7, and the transportation motor are controlled. Still further, it is also possible that under the control of the CPU, printing data is received from external devices such as a host apparatus, and an image is printed according to the printing data.

Other embodiment

In the above-described embodiment, a total of two detection elements are provided at positions corresponding to the ink ejection openings at both ends of the nozzle array. However, alternatively, detection elements may be provided so as to oppose all the ink ejection openings, in this case, the deviation amount can be corrected independently for every ink ejection opening. Further, detection elements may be provided so that each one corresponds to every group of a plurality of ink ejection openings.

Still further, by setting the tolerable deviation range of printing dot to smaller than 1 dot, the adjusting amount of the ejection timing can be finely set according to the tolerable deviation. Therefore, the deviation of printing dot formation position can be corrected more accurately. Yet further, the design center C may be inclined by a predetermined angle relative to the primary scanning direction. In this case, the printing head can be controlled so that deviation amount of the printing element from the inclined center C is corrected.

Yet further, it is possible to provide a common detection element for a plurality of printing heads, so that images printed by the respective printing heads are detected. Therefore, the actual situations such as printing characteristics and mounting error and the like of the plurality of printing heads can be efficiently detected, so that the detection result is utilized in controlling the printing heads. In this case, for example, the printing heads are driven one by one, and images printed by the respective printing heads are successively detected, so that the detection results are utilized in respective controls of the printing heads.

Yet further, the present invention can also be applied to printing heads provided with various printing elements such as thermal transfer type heads and the like, in addition to the printing head provided with the ink-jet printing element.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. A printing apparatus for printing an image on a printing medium while relatively moving at least one of a printing head provided with an array of a plurality of printing elements and the printing medium, said apparatus comprising:

a carriage mounting said printing head, and movable relative to the printing medium in a scanning direction crossing said array of said plurality of printing elements;

detection means mounted on said carriage for detecting printing positions of an array of printed pixels corresponding to said array of said plurality of printing elements, said detecting means detecting printed pixels printed by any of said plurality of printing elements;

determining means for determining all of the printing elements from among said plurality of printing elements that have displacement amounts of printing positions of corresponding printed pixels from a printing position of a printed pixel corresponding to one end side of said array of printing elements equal to or greater than a predetermined amount; and control means for adjusting drive timing of said plurality of printing elements according to detection results of said detection means so as to make printing positions of subsequently printed pixels close to a predetermined center position, said control means adjusting the drive timing of all of said printing elements determined by said determining means, so that a deviation amount between printing positions of printed pixels corresponding to the one end side and the other end side of said array of printing elements is equal to or smaller than the predetermined amount, said control means not adjusting the drive timing of a plurality of printing elements that are positioned continuously from a printing element positioned at the one end side of said array of printing elements and that have displacement amounts of printing positions of corresponding printed pixels from the printing position of the printed pixel corresponding to the one end side of said array of printing elements less than the predetermined amount, and said control means adjusting the drive timing of any of printing elements that are positioned continuously from a printing element positioned at the other end side of said array of printing elements and that have displacement amounts of printing positions of corresponding printed pixels from the printing position of the printed pixel corresponding to the one end side of said array of printing elements equal to or greater than the predetermined amount, wherein all of said printing elements determined by said determining means exclude the one end side of said array of printing elements.

2. The printing apparatus as claimed in claim 1, wherein said control means adjusts the drive timing of said plurality of printing elements so as to make deviation amounts of the printed pixels in the scanning direction to be equal or less than one of the printed pixels in size.

3. The printing apparatus as claimed in claim 1, wherein said printing head is replaceably mounted on said carriage, and said detection means is mounted fixedly on a predetermined position of said carriage.

4. The printing apparatus as claimed in claim 1, further comprising:

moving means for moving said carriage in a primary scanning direction; and transportation means for transporting the printing medium in a secondary scanning direction crossing the primary scanning direction.

5. The printing apparatus as claimed in claim 1, wherein said plurality of printing elements of said printing head are arranged in a direction crossing the scanning direction when said printing head is mounted on said carriage; and said detection means has a plurality of detection elements arranged at predetermined positions of said carriage so as to be arranged along a specified direction crossing the scanning direction.

6. The printing apparatus as claimed in claim 1, wherein said detection means is movable with a plurality of printing heads, and is provided commonly to said plurality of printing heads so as to detect images printed by respective printing heads of said plurality of printing heads; and said control means controls said plurality of printing heads according to detection results of said detection means.

7. The printing apparatus as claimed in claim 1, wherein said detection means comprises a light source for irradiating light to the printing medium and a photoelectric conversion device for receiving reflected light from the printing medium.

8. The printing apparatus as claimed in claim 1, wherein said printing head is an ink-jet printing head provided with said plurality of printing elements, which are capable of ejecting ink.

9. The printing apparatus as claimed in claim 8, wherein said printing elements of said ink-jet printing head comprise electrothermal converters for generating thermal energy as ink ejection energy.

10. A printing method for printing an image on a printing medium while relatively moving at least one of a printing head provided with an array of a plurality of printing elements and the printing medium, comprising the steps of:

relatively moving at least one of the printing head and the printing medium in a scanning direction crossing the array of the printing elements so that an array of printed pixels corresponding to the array of the printing elements is printed on the printing medium;

detecting printing positions of the array of printed pixels by detecting printed pixels printed by any of the plurality of printing elements;

determining all of the printing elements from among the plurality of printing elements that have displacement amounts of printing positions of corresponding printed pixels from a printing position of a printed pixel corresponding to one end side of the array of printing elements equal to or greater than a predetermined amount; and adjusting drive timing of the plurality of printing elements according to detection results of the printing positions so as to make printing positions of subsequently printed pixels close to a predetermined center position, wherein said adjusting step adjusts drive timing of all of the printing elements determined in said determining step, so that a deviation amount between printing positions of printed pixels corresponding to the one end side and the other end side of the array of printing elements is equal to or smaller than the predetermined amount, wherein the drive timing of a plurality of printing elements that are positioned continuously from a printing element positioned at the one end side of the array of printing elements and that have displacement amounts of printing positions of corresponding printed pixels from the printing position of the printed pixel corresponding to the one end side of the array of printing elements less than the predetermined amount is not adjusted, and the drive timing of any of printing elements that are positioned continuously from a printing element positioned at the other end side of the array of printing elements and that have displacement amounts of printing positions of corresponding printed pixels from the printing position of the printed pixel corresponding to the one end side of the array of printing elements equal to or greater than the predetermined amount is adjusted, and wherein all of the printing elements determined in said determining step exclude the one end side of the array of printing elements.

* * * * *